US006639217B1

(12) United States Patent
Li

(10) Patent No.: US 6,639,217 B1
(45) Date of Patent: Oct. 28, 2003

(54) IN-LINE MATRIX ASSISTED LASER DESORPTION/IONIZATION MASS SPECTROMETRY (MALDI-MS) SYSTEMS AND METHODS OF USE

(75) Inventor: Gangqiang Li, Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/324,423

(22) Filed: Dec. 20, 2002

(51) Int. Cl.[7] ..... H01J 59/44
(52) U.S. Cl. ..... 250/288
(58) Field of Search ..... 250/288, 281, 250/282, 287

(56) References Cited

U.S. PATENT DOCUMENTS 4,527,059 A * 7/1985 Benninghoven et al. .... 250/288
4,740,692 A * 4/1988 Yamamoto et al. ..... 250/288

* cited by examiner

*Primary Examiner*—Kiet T. Nguyen

(57) ABSTRACT

Mass spectrometry systems and methods are disclosed. Briefly described, one embodiment of the mass spectrometry system, among others, includes a mass spectrometer, a laser generator, and a sample substrate. The mass spectrometer includes a first end and a second end and the laser generator produces a laser radiation beam that travels along a first path. The sample substrate holds a sample at the first end of the mass spectrometer, where the sample produces a plurality of ions that travel along a second path that is substantially parallel the first path but towards the second end of the mass spectrometer.

29 Claims, 1 Drawing Sheet

IN-LINE MATRIX ASSISTED LASER DESORPTION/IONIZATION MASS SPECTROMETRY (MALDI-MS) SYSTEMS AND METHODS OF USE

BACKGROUND

A mass spectrometry system is an analytical system used for quantitative and qualitative determination of the compounds of a material (e.g., chemical mixtures and biological samples). In general, a mass spectrometry system uses an ion source to produce electrically charged particles (e.g., molecular or polyatomic ions) from the material to be analyzed. Once produced, the electrically charged particles are introduced to the mass spectrometer and separated by a mass analyzer based on their respective mass-to-charge ratios. The abundance of the separated electrically charged particles are then detected and a mass spectrum of the material is produced. The mass spectrum is analogous to a fingerprint of the sample material being analyzed. The mass spectrum provides information about the mass-to-charge ratio of a particular compound in a mixture sample and, in some cases, molecular structure of that component in the mixture.

The molecular weight of a compound is often determined by the use of a mass spectrometry system having a single mass analyzer. The mass analyzer may include a quadrupole (Q) m ass analyzer, a time-of-flight mass analyzer (TOF-MS), an ion trap mass analyzer (IT-MS), etc. Tandem mass spectrometer s (i.e., tandem-MS or MS/MS) are often needed to analyze samples having complicated molecules. Tandem mass analyzers typically include two mass analyzers of the same or different type (e.g., TOF-TOF MS and Q-TOF MS).

In a tandem mass spectrometry analysis, electrically charged particles are transmitted to the first mass analyzer and an ion of particular interest is selected. The selected ion is transmitted to a dissociation cell where the selected ion is fragmented. The ionic fragments of the dissociated ion are transmitted to the second mass analyzer for mass analysis. The fragmentation pattern obtained from the second mass analyzer is then analyzed to determine the structure of the corresponding molecule.

Matrix assisted laser desorption/ionization mass spectrometry (MALDI-MS) is of particular importance for the analysis of biological samples, which was introduced by Karas et.al. (Karas, M.; Hillenkamp, F., *Anal Chem.* 60, p. 2299, 1988) and Tanaka et.al. (Tanaka, K.; Waki, H.; Ido, Y.; Akita, S.; Yoshida, Y.; Yoshica, T., *Rapid Commun. Mass Spectrom.* 2, p.151, 1988) and has become established as a method of mass spectrometry used to analyze substances such as polypeptides, polynucleotides, proteins, DNA fragments, biopolymers, and other large molecules.

MALDI-MS allows for desorption and ionization of non-volatile samples (e.g., biological samples) from a solid-state phase directly into the gas phase without charring, fragmentation, or chemical degradation. The sample (analyte) is suspended or dissolved in a matrix. Matrices are small organic compounds that are co-crystallized with the analyte.

Laser radiation (i.e., a laser beam) produced by a laser generator, serves as a desorption and ionization source in MALDI-MS. The matrix absorbs the laser energy and causes part of the illuminated sample to vaporize. A rapidly expanding matrix plume carries some of the analyte ions into the vacuum of the mass spectrometer. The matrix molecules absorb most of the incident laser energy minimizing sample damage and ion fragmentation (i.e., soft ionization). Laser generators of various wavelengths (e.g., ultraviolet and infrared) have been used in MALDI-MS.

Conventionally, most laser desorption/ionization sources are performed in a vacuum (vacuum MALDI). In this regard, a sample substrate is under pressure conditions that are similar to the pressure in the mass analyzer (i.e., $1\times10^{-7}$ Torr). However, MALDI performed at atmospheric pressure (AP-MALDI) (as described in U.S. Pat. No. 5,965,884, which is included herein by reference) has also become available commercially (AP/MALDI™, available from MassTech Inc. of, Burtonsville, Md. is one example). The advantages of AP-MALDI over vacuum MALDI include simple sample handling and reduced analysis time.

Thus, there is a need in the industry for an MALDI-MS system that requires minimal alignment of the laser desorption/ionization source, while also having a high ion throughput. In addition, there is a need in the industry for a MALDI-MS system that can obtain sample ions from different points on a sample surface without having to realign the laser (i.e., profiling a sample), while also having a high ion throughput and being cost effective.

SUMMARY OF THE INVENTION

Embodiments of the present invention provide mass spectrometry systems and methods for matrix assisted laser dissociation ionization of a sample. Briefly described, one embodiment of the mass spectrometry system, among others, includes a mass spectrometer having a first end and a second end opposite the first end. In addition, the mass spectrometry system includes a laser generator that produces a laser radiation beam that travels along a first path. Furthermore, the mass spectrometry system includes a sample substrate for holding a sample at the first end of the mass spectrometer. The sample produces a plurality of ions that travels along a second path towards the second end of the mass spectrometer that is substantially parallel the first path.

Other systems, methods, features, and advantages of the present invention will be or become apparent to one with skill in the art upon examination of the following drawings and detailed description. It is intended that all such additional systems, methods, features, and advantages be included within this description, be within the scope of the invention, and be protected by the accompanying claims.

BRIEF DESCRIPTION OF THE DRAWINGS

Aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Embodiments of the present invention provide for an in-line laser matrix assisted laser desorption/ionization mass spectrometry system. Such a system will be referred to using the acronym ILL-MALDI-MS. The ELL-MALDI-MS system has the laser system aligned in-line with the sampling system (i.e., sample), so that a line-of-sight through at least a portion of the mass spectrometer (which will depend upon the mass spectrometer selected for the ILL-MALDI-MS) to the sampling system is obtained. In other words, when the laser system emits laser radiation (i.e., a laser beam), the laser radiation passes th rough the m ass spectrometer an d impinges upon the sample at a angle substantially perpendicular (i.e., about 90 degree) to the sample.

In-line alignment of the laser system facilitates symmetric focusing of the laser radiation on the sample and provides better alignment between the sampe, laser radiation, and sampling orifice. In addition, in-line alignment produces precise sampling position and stable sample signals as well as increases ion collection efficiency. Therefore, detection sensitivity is improved using in-line alignment.

In addition, in-line alignment of the laser system al lows for precise profiling of samples. Another benefit of aligning the laser system in-line with the sampling substrate is that simple and cost effective optic systems can be used to focus the laser radiation.

Further, the position of the sampling substrate (i.e., sample) relative to the sampling orifice can be adjusted in three dimensions (i.e., x-, y-, and z-directions) without substantially changing the focus of the laser radiation on the sample. This decreases problems associated with realignment of the laser system and/or sampling substrate. In-line arrangement of the laser system allows the position of the sample to be adjusted without substantially affecting the focus of the laser. An additional benefit of the ILL-MALDI-MS is that the signal from the analyte ion can be optimized for a wide range of samples and matrices by adjusting the position of the sampling substrate relative to the sampling orifice.

Figure 1:
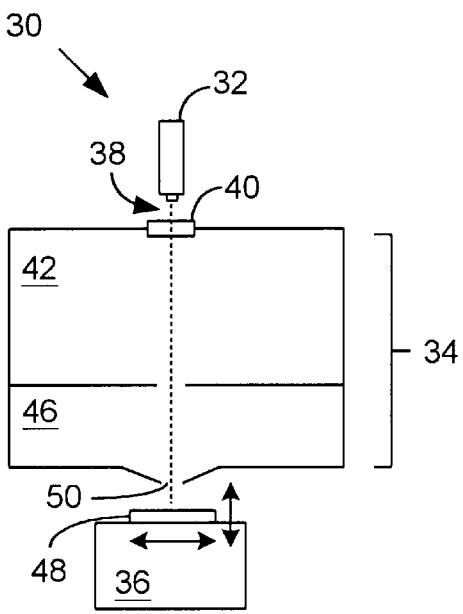
FIG. 1 is a block diagram that illustrates a representative schematic diagram of an ILL-MALDI-MS system.

FIG. 1 is a block diagram that illustrates a representative ILL-MALDI-MS system 30. The ILL-MALDI-MS system 30 includes a laser system 32, a mass spectrometer 34, and a sampling system 36. The laser system 32 and the sampling system 36 are located at opposite ends of the ILL-MALDI-MS system 30. The mass spectrometer 34 includes mass analyzer/detection system 42, and an ion optic system 46. The laser system 32 is located near the mass analyzer/detection system 42, while the ion optic system 46 is located near the sampling system 36.

The laser system 32 emits laser radiation 38 that passes through an optic window 40 positioned on the mass analyzer/detection system 42. The laser radiation 38 passes through mass analyzer/detection system 42, and the ion optic system 46, as shown in FIG. 1. The laser radiation 38 exits the ion optic system 46 by passing through the sampling orifice 50. Subsequently, the laser radiation 38 impinges substantially perpendicular (i.e., 90 degree) to a major axis of a sample (not shown) located upon the sampling substrate 48 of the sampling system 36.

The sample absorbs the laser energy, which causes part of the laser illuminated portion of the sample to vaporize. The rapidly expanding matrix plume carries some of the analyte ions into the vacuum of the ion optic system 46 The ions may take the form of a packet of ions (i.e., generated with laser radiation pulse) or a constant stream of ions (i.e., generated with a constant beam of laser radiation). Once the sample molecules are vaporized and ionized, the ions are transferred via ion optic system 46 into the mass analyzer/detection system 42. The ions are separated in the mass analyzer/detection system 42 according to their mass-to-charge ratio and detected by a detector based on their relative abundance.

This process can be performed a plurality of times for a particular position upon the sample. Optionally, the sample can be repositioned by moving the sampling substrate 48 in the x-, y-, and/or z-axis to obtain ions from various positions of the sample (e.g., profiling). However, in most circumstances, the laser system 32 will not need to be repositioned. Then after the sampling substrate 48 is repositioned, the process can be repeated.

The ion optic system 46 transmits and/or manipulates ions and can include electrostatic elements, radio frequency (RF) elements, or a combination thereof. A condition of the ion beam (i.e., energy, phase space, etc.) can be determined using ion optic system 46. In general, the sampling orifice 50 serves as an ion optic element to extract ions into the mass spectrometer 34. In addition, the sampling orifice 50 acts as a vacuum conducting plate to separate the mass spectrometer 34 from atmospheric pressure. Further, the ion optic system 46 includes other vacuum system components and electronic system components, as are known in the art.

The sampling orifice 50 is usually a circular hole with a diameter of typically about 0.1 to 3 mm, but more typically of about 0.3 to 1.5 millimeters. The sampling orifice 50 usually facilitates the passage of ions into the mass spectrometer 34 and also separates the mass spectrometer 34 from atmospheric pressure. Since the laser radiation 38 travels through the sampling orifice 50 the sampling orifice 50 can be used as an aperture for the laser radiation 38 (i.e., the sampling orifice 50 limits the cross section of laser radiation 38).

Embodiments of the present invention can include one or more ion optic configurations in the ion optic system 46 of the ILL-MALDI-MS system 30. Preferably, the ion optic system 46 is a combination of electrostatic and RF ion optic elements.

The mass analyzer/detection system 42 can include a mass analyzer such as, for example, a time-of-flight (TOF) mass analyzer, an ion trap mass analyzer (IT-MS), a quadrupole (Q) mass analyzer, a magnetic sector mass analyzer, or an ion cyclotron resonance (ICR) mass analyzer. In one embodiment, because it can be used to separate ions having very high masses, the mass analyzer is a TOF mass analyzer.

In addition, the mass analyzer/detection system 42 includes an ion detector. A detector is a device for recording the number of ions that are subjected to an arrival time or position in a mass spectrometry system, as is known in the art. Ion detectors can include, for example, a microchannel plate multiplier detector, an electron multiplier detector, or a combination thereof In addition, the mass analyzer/detection system 42 includes vacuum system components and electronic system components, as are known in the art.

The optic window 40, located on the mass analyzer/detection system 42 can include an optic lens through which laser radiation 38 can pass. In accordance to the laser generator chosen for the ionization, the optic window 40 usually has high transmission efficiency for the particular wavelength. The optic window 40 can be a flat plate for transmitting the laser radiation, or it can be a curved surface that functions as a lens to focus the laser radiation 38. In addition, the optic window 40 is vacuum-sealed so that a low pressure (on the order of $1\times10^{-7}$ Torr) in the mass analyzer/detection system 42 is maintained.

The laser system 32 includes a laser generator and a laser optic system. The laser generator can include a laser generator such as, for example, a Nd:YAG laser having an output wavelength of 1060 nanometers and a harmonic wavelength of 533 nanometers, 353 nanometers and 256 nanometers, a nitrogen laser having an output wavelength 337 nanometers, or a $CO_2$ laser having an output wavelength 10.6 micrometers, a tunable laser, or another laser having a wavelength ranging from ultraviolet wavelengths to infrared wavelengths, as are known in the art. The laser used in a laser desorption/ionization source is usually a pulsed laser with a repetition rate of 1 to 100 Hertz, typically 10 to 20 Hertz. Other laser optic systems, known in the art, typically used in conjunction with laser generators can be used in the laser system 32.

The sampling system 36 includes a sampling substrate 48. The sampling system 36 facilitates the movement (i.e., x-y-z directions) of the sampling substrate 48 manually or through the use of a computer system. Sample substrate systems 36 are known in the art and will not be discussed in detail.

The sampling system 36 shown in FIG. 1 is at atmospheric pressure (i.e., atmospheric pressure (AP) MALDI), however, another embodiment of the present invention can be configured to include the sampling system 36 in a vacuum (i.e., vacuum MALDI). In vacuum MALDI, the mass spectrometer is in a first vacuum, while the sampling system is in a second vacuum.

Preferably, the sampling substrate 48 is mounted substantially perpendicular to the optical axis of the sampling orifice 50, and, therefore, substantially perpendicular to the laser radiation. In case of an imperfection of the alignment, the sampling substrate 48 can be tilted about 10 degrees or about 5 degrees to align the laser radiation and the sampling substrate 48 so that they are substantially perpendicular. Preferably, the tilt angle is less than about 1 degree.

In the embodiment illustrated in FIG. 1, the laser radiation 38 is generated in a first region at atmospheric pressure. Then, the laser radiation 38 travels through the optic window 40 into the mass analyzer/detection system 42, and the ion optic lens system 46, which are in a second region and under a vacuum ($1\times10^{-2}$ Torr to about 1×10−7 Torr). Subsequently, the laser radiation 38 exits the vacuum through the sampling orifice 50 and impinges upon the sample, which is in a third region at atmospheric pressure.

Figure 2:
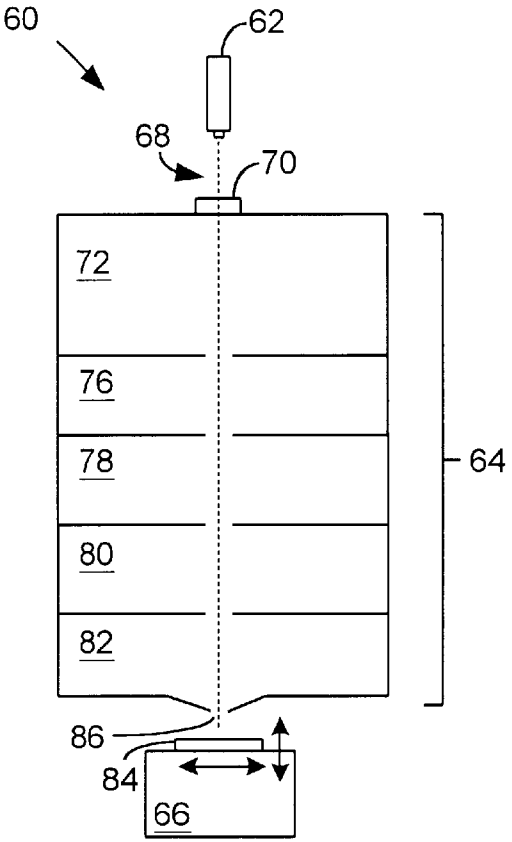
FIG. 2 is a block diagram illustrating another representative schematic diagram of an ILL-MALDI-MS system.

FIG. 2 is a block diagram that illustrates an ILL-MALDI-MS system 60 that includes a laser system 62, a mass spectrometer 64, and a sampling system 66. The laser system 62 and the sampling system 66 are located on opposite ends of the ILL-MALDI-MS system 60. The mass spectrometer 64 includes a first ion optic system 82, a first mass analyzer 80, a collision/fragmentation system 78, a second ion optic system 76, and a second mass analyzer/detection system 72. The first optic system 82 is located near the sampling system 66, while the second mass analyzer/detection system 72 is located near the laser system 62.

The second mass analyzer/detection system 72, the optic window 70, and the laser system 62 are analogous to the mass analyzer/detection system 42, the optic window 40, and the laser system 32 discussed in reference to FIG. 1. The first mass analyzer 80 is analogous to the mass analyzer discussed in reference to FIG. 1. However, the first mass analyzer 80 and the mass analyzer of the second mass analyzer/detection system 72 can be different mass analyzers (i.e., quadrupole mass analyzer and a TOF mass analyzer, respectively). The first optic system 82 and the second optic system 76 are analogous to the optic system 46 discussed in reference to FIG. 1. However, the first optic system 82 and the second optic system 76 can have different configurations. The sampling substrate 86 is analogous to the sampling substrate 50.

The laser system 62 emits laser radiation 68 that passes through an optic window 70. The laser radiation 68 passes through the second mass analyzer/detection system 72, the second ion optic system 76, the collision/fragmentation system 78, the first mass analyzer 80, and the first ion optic system 82. The laser radiation 68 exits the first ion optic system 82 by passing through the sampling orifice 86. Subsequently, the laser radiation 68 impinges substantially perpendicular to a major axis of a sample (not shown) located upon the sampling substrate 84 of the sampling system 66.

The sample absorbs the laser energy, which causes the laser illuminated portion of the sample to vaporize. The rapidly expanding matrix plume carries some of the analyte ions into the vacuum of the first ion optic system 82. Once the sample molecules are vaporized and ionized they are transferred into the first mass analyzer 80 (e.g., time-of-flight mass spectrometer (TOF-MS)) where a particular analyte ion is selected for further analysis.

After the selected analyte ion passes through the first mass analyzer 80, the selected analyte ion can be dissociated via collision-induced dissociation or photodissociation in the collision/dissociation system 78. Subsequently, the resulting ions (fragments) are focused with a second ion optic system 76 into the second mass analyzer/detection system 72, and then detected by a detector based on their relative abundance.

The collision/fragmentation system 78 functions to dissociate the selected ion. The collision/fragmentation system 78 can include an ion optic system, a fragment confining system, and gas inlets. Alternatively, collision/fragmentation system 78 includes a photon source that provides photons that are used to photodissociate the selected ion. However, collision/fragmentation systems 78 are known in the art and will not be discussed in detail.

In another embodiment, if the first mass analyzer 80 and the second mass analyzer of the second mass analyzer/detection system 72 are TOF mass analyzers then the ions from the sample will change direction (generally a 90° turn). In this situation, the laser system 62 and optic window 70 would be located adjacent the first mass analyzer 80 rather than the second mass analyzer/detection system 72 to achieve in-line alignment. This situation may also occur when the first mass analyzer 80 is another type of mass analyzer. Thus, alternative configuration of the mass spectroscopy systems are contemplated to be within the scope of this disclosure in cases where the location of the laser system is altered to accomplish in-line alignment of the laser system and the sampling system.

In still another embodiment the ILL-MALDI-MS system may include, for example, a triple quadrupole mass analyzer configuration, a quadrupole-TOF mass analyzer configuration, or a combination of an ion trap with a TOF-MS.

Figure 3:
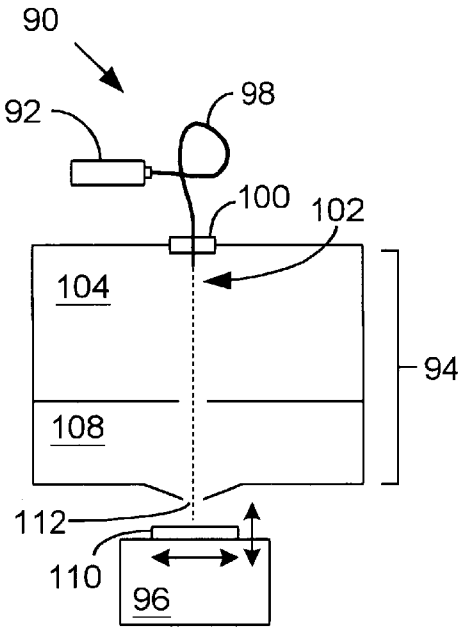
FIG. 3 is a block diagram illustrating still another representative schematic diagram of an ILL-MALDI-MS system.

FIG. 3 is a block diagram that illustrates a representative ILL-MALDI-MS system 90. The ILL-MALDI-MS system 90 that includes a laser system 92, a mass spectrometer 94, and a sampling system 96. The laser system 92 and the sampling system 96 are located on opposite ends of the ILL-MALDI-MS system 90. The mass spectrometer 94 includes a mass analyzer/detection system 104, and an ion optic system 108. The mass analyzer/detection system 104 is located near the laser system 92, while the ion optic system 108 is located near the sampling system 96.

The laser system 92, mass analyzer/detection system 104, the ion optic system 108, and the sampling system 96 are analogous to the laser system 32, the mass analyzer/detection system 42, the ion optic system 46, and the sampling system 36 discussed in reference to FIG. 1.

The laser system 92 is coupled to the detection system 104 via a section of optical fiber 98. The optical fiber 98 guides the laser radiation 102 into the mass analyzer/detection system 104 through the optic window 100. The laser radiation 102 passes through the mass analyzer/detection system 104 and the ion optic system 108, as shown in FIG. 3. The laser radiation 102 exits the ion optic system 108 by passing through the sampling orifice 112. Subsequently, the laser radiation 102 impinges substantially perpendicular to a major axis of a sample (not shown) located upon the sampling substrate 110.

The sample absorbs the laser radiation 102, which causes part of the laser illuminated sample to vaporize. The rapidly expanding matrix plume carries some of the analyte ions into the vacuum of the ion optic system 108. Once the sample molecules are vaporized and ionized the ions are transferred into the mass analyzer/detection system 104 (e.g., time-of-flight mass spectrometer (TOF-MS)), where the ions are separated and detected with a detector based on their relative abundance.

The ILL-MALDI-MS system 90 incorporates an optical fiber 98, which is known in the art, to guide the laser radiation 102 into the mass analyzer/detection system 104 through optic window 100. In this embodiment, the optical fiber 98 can be used instead of or in conjunction with the laser lens system of the laser system 92.

In the embodiment illustrated in FIG. 3, the laser radiation 102 travels through the optical fiber 98 and into the mass analyzer/detection system 104, and the ion optic system 108, which are under vacuum (about $1\times10^{-2}$ Torr to about $1\times10^{-7}$ Torr). Subsequently, the laser radiation 102 exits the vacuum through the sampling orifice 112 and impinges upon the sample, which is at atmospheric pressure.

It should be emphasized that the above-described embodiments of the present invention, are merely possible examples of implementations, merely set forth for a clear understanding of the principles of the invention. Many variations and modifications may be made to the above-described embodiment(s) of the invention without departing substantially from the principles of the invention. All such modifications and variations are intended to be included herein within the scope of this disclosure and the present invention and protected by the following claims.

I claim:

1. A mass spectrometry system, comprising:

a mass spectrometer having a first end and a second end, wherein the first end includes a sampling orifice and the second end includes an optic window, and wherein the sampling orifice is in-line with the optic window; and a laser system located at the second end of the mass spectrometer, so that when the laser system emits laser radiation, the laser radiation travels first through the optic window and then the sampling orifice of the mass spectrometer.

2. The mass spectrometry system of claim 1, further comprising a sampling system located at the first end of the mass spectrometer in-line with the sampling orifice, wherein the sampling system includes a sampling substrate, and wherein when the laser system emits laser radiation, the laser radiation travels through the optic window and the sampling orifice of the mass spectrometer and impinges upon the sampling substrate.

3. The mass spectrometry system of claim 2, wherein when the laser system emits laser radiation, the laser radiation impinges upon the sampling substrate at about a 90 degree angle relative to the sampling substrate.

4. The mass spectrometry system of claim 2, wherein the sampling substrate is located in a pressure region at atmospheric pressure.

5. The mass spectrometry system of claim 2, wherein the sampling substrate is located in a pressure region under a vacuum.

6. The mass spectrometry system of claim 2, wherein the sampling substrate includes multiple samples deposited on it.

7. The mass spectrometry system of claim 1, further comprising an optical fiber interconnected between the laser system and the mass spectrometer.

8. The mass spectrometry system of claim 1, wherein the mass spectrometer includes a time-of-flight mass analyzer.

9. The mass spectrometry system of claim 1, wherein the laser system includes a laser generator and a laser optic system.

10. The mass spectrometry system of claim 9, wherein the laser generator is selected from a nitrogen laser generator, ultraviolet laser generator, and infrared laser generator.

11. The mass spectrometry system of claim 1, wherein the mass spectrometer includes a first mass analyzer and a second mass analyzer.

12. The mass spectrometry system of claim 11, wherein the first mass analyzer and second mass analyzer are the same type of mass analyzer.

13. The mass spectrometry system of claim 11, wherein the first mass analyzer and second mass analyzer are different types of mass analyzers.

14. The mass spectrometry system of claim 1, wherein the sampling orifice has a diameter of about 0.1 millimeters to 3 millimeters.

15. A mass spectrometry system, comprising:

a mass spectrometer having a first end and a second end opposite the first end;

a sample substrate for holding a sample at the first end of the mass spectrometer;

a laser generator located at the second end of the mass spectrometer that emits a laser beam toward the sample substrate at the first end of the mass spectrometer to ionize the sample; and a detector for detecting the ionized sample.

16. The mass spectrometry system of claim 15, wherein the laser generator is selected from Nd:YAG laser generator, a nitrogen laser generator, and a $CO_2$ laser generator.

17. The mass spectrometry system of claim 15, further comprising a sample orifice located at the first end of the mass spectrometer and wherein an ion optic system locate d at the second end of the mass spectrometer.

18. The mass spectrometry system of claim 17, wherein the sample substrate, the sample orifice, and the ion optic system are substantially in line with one another.

19. The mass spectrometry system of claim 15, wherein the laser generator emits a laser radiation beam that travel along a first path and then impinges upon the sample located on the sampling substrate at about a 90 degree angle relative to the sampling substrate, wherein a plurality of ions are generated from the laser radiation impinging upon the sample, and wherein the plurality of ions travels in a direction opposite the laser radiation beam along an second path substantially parallel to the first path.

20. A mass spectrometry system, comprising:

a mass spectrometer having a first end and a second end opposite the first end;

a laser generator that produces a laser radiation beam that travels along a first path; and a sample substrate for holding a sample at the first end of the mass spectrometer, wherein the sample produces a plurality of ions that travels along a second path towards the second end of the mass spectrometer that is substantially parallel the first path.

21. A method of matrix assisted laser dissociation ionization of a sample, comprising:

providing a mass spectrometer having a first end and a second end, wherein the first end includes a sampling orifice and the second end includes an optic window, and wherein the sampling orifice is in-line with the optic window;

providing a laser system located at the second end of the mass spectrometer and positioned in-line with the optic window and sampling orifice;

producing laser radiation that passes through the optic window and the sampling orifice of the mass spectrometer and impinges upon the sample producing at least one ion from the sample.

22. The method of claim 21, further comprising:

a mass spectrometer using first and second mass analyzers; and selecting one of the at least one ions using a first mass analyzer;

analyzing the selected at least one ion with a second mass analyzer; and detecting the selected at least one ion with a detector system.

23. The method claim 21, further comprising:

selecting one of the at least one ions using a first mass analyzer;

dissociating the selected at least one ion with a dissociation/ fragmentation system;

producing at least one secondary ion from the selected at least one ion;

analyzing at least one secondary ion with a third mass analyzer; and detecting at least one secondary ion with a detector system.

24. The method of claim 21, further comprising:

providing a optical fiber interconnected with the mass spectrometer and the laser system; and directing laser radiation through the optical fiber.

25. The method of claim 21, further comprising:

providing a sampling system having a sampling substrate positioned in-line with the sampling orifice;

moving the sampling substrate without realigning the laser system; and;

producing at least one ion from a different location on the sample substrate.

26. The method of claim 21, wherein producing laser radiation includes:

producing laser radiation that travels from the mass spectrometer that is in a vacuum pressure region to the sampling system that is in an atmospheric pressure region.

27. The method of claim 21, wherein producing laser radiation includes:

producing laser radiation that travels from the mass spectrometer that is in a first vacuum region to the sampling system that is in a second vacuum region.

28. The method of claim 27, further comprising:

producing laser radiation with wavelengths ranging from ultraviolet to infrared wavelengths.

29. The method of claim 21, further comprising:

aligning the laser radiation perpendicular to the sample.

* * * * *